US009018507B2

(12) United States Patent
Tabata

(10) Patent No.: US 9,018,507 B2
(45) Date of Patent: Apr. 28, 2015

(54) MUSICAL INSTRUMENT THAT GENERATES ELECTRONIC SOUND, LIGHT-EMISSION CONTROLLER USED IN THIS MUSICAL INSTRUMENT, AND CONTROL METHOD OF MUSICAL INSTRUMENT

(75) Inventor: Yuji Tabata, Tokyo (JP)

(73) Assignee: Casio Computer Co., Ltd., Tokyo (JP)

( * ) Notice: Subject to any disclaimer, the term of this patent is extended or adjusted under 35 U.S.C. 154(b) by 159 days.

(21) Appl. No.: 13/590,690

(22) Filed: Aug. 21, 2012

(65) Prior Publication Data

US 2013/0047823 A1 Feb. 28, 2013

(30) Foreign Application Priority Data

Aug. 23, 2011 (JP) ..... 2011-181795
Aug. 14, 2012 (JP) ..... 2012-179920

(51) Int. Cl.
*G10H 3/06* (2006.01)
*G10H 1/00* (2006.01)

(52) U.S. Cl.
CPC ..... *G10H 1/0008* (2013.01); *G10H 2220/061* (2013.01); *G10H 2220/185* (2013.01); *G10H 2220/201* (2013.01); *G10H 2220/395* (2013.01); *G10H 2220/455* (2013.01)

(58) Field of Classification Search
CPC ..... G06F 3/014; G06F 3/017; G06F 3/0346; G10H 1/348; G10H 2220/185; G10H 2220/201; G10H 2220/206; G10H 2220/226; G10H 2220/395; G10H 2220/525; G10H 2240/211; G02B 6/4206; H04W 4/027; H04B 1/0346; H04B 1/3833; G10K 11/352; G10G 1/02
See application file for complete search history.

(56) References Cited

U.S. PATENT DOCUMENTS

| | | | | |
|---|---|---|---|---|
| 8,664,508 | B2 * | 3/2014 | Tabata | 84/723 |
| 2002/0166439 | A1 * | 11/2002 | Nishitani et al. | 84/600 |
| 2007/0033012 | A1 * | 2/2007 | Rosenberg | 704/206 |
| 2010/0245232 | A1 * | 9/2010 | Birnbaum et al. | 345/156 |
| 2012/0086637 | A1 * | 4/2012 | Ye et al. | 345/158 |
| 2012/0258800 | A1 * | 10/2012 | Mikhailov | 463/37 |
| 2013/0047823 | A1 * | 2/2013 | Tabata | 84/639 |

(Continued)

FOREIGN PATENT DOCUMENTS

| | | |
|---|---|---|
| CN | 101590329 A | 12/2009 |
| JP | 06-301476 A | 10/1994 |

(Continued)

OTHER PUBLICATIONS

Chinese Office Action dated Mar. 28, 2014 in counterpart Chinese Application No. 201210375462.2.
Japanese Office Action dated Jan. 7, 2014 (and English translation thereof) in counterpart Japanese Application No. 2012/197920.

*Primary Examiner* — Marlon Fletcher
(74) *Attorney, Agent, or Firm* — Holtz, Holtz, Goodman & Chick PC

(57) ABSTRACT

A musical instrument (1) includes a stick (10) to be held by a player and provided with a marker (15) at a leading end that emits light and switches off; a camera unit (20) that captures an image of the player holding the stick (10); and a center unit (30) that generates a percussion instrument sound based on a position of the marker (15) while emitting light in image-capture space captured by the camera unit (20), in which the stick (10) causes the marker (15) to emit light under the condition of detecting start of a down swing movement by the player, and causes the marker (15) to switch off under the condition of detecting the end of this movement.

12 Claims, 7 Drawing Sheets

(56) References Cited

U.S. PATENT DOCUMENTS

| | | | | |
|---|---|---|---|---|
| 2013/0076617 | A1* | 3/2013 | Csaszar et al. | 345/156 |
| 2013/0077831 | A1* | 3/2013 | Momozono et al. | 382/107 |
| 2013/0090166 | A1* | 4/2013 | Mao et al. | 463/31 |
| 2013/0118339 | A1* | 5/2013 | Lee et al. | 84/725 |
| 2013/0228062 | A1* | 9/2013 | Tabata | 84/602 |
| 2013/0239780 | A1* | 9/2013 | Tabata | 84/602 |
| 2013/0239783 | A1* | 9/2013 | Tabata et al. | 84/609 |
| 2013/0239785 | A1* | 9/2013 | Tabata | 84/609 |

FOREIGN PATENT DOCUMENTS

| | | | |
|---|---|---|---|
| JP | 2001-333156 | A | 11/2001 |
| JP | 2002-023742 | A | 1/2002 |
| JP | 2002-203401 | A | 7/2002 |
| JP | 3599115 | B2 | 9/2004 |
| JP | 2008-118625 | A | 6/2008 |

* cited by examiner

MUSICAL INSTRUMENT THAT GENERATES ELECTRONIC SOUND, LIGHT-EMISSION CONTROLLER USED IN THIS MUSICAL INSTRUMENT, AND CONTROL METHOD OF MUSICAL INSTRUMENT

This application is based upon and claims the benefit of priority from the prior Japanese Patent Application Nos. 2011-181795 and 2012-179920, respectively filed Aug. 23, 2011 and Aug. 14, 2012, and the entire contents of which are incorporated herein by reference.

BACKGROUND OF THE INVENTION

1. Field of the Invention

The present invention relates to a musical instrument that generates electronic sound and a light-emission controller used in this musical instrument.

2. Related Art

Conventionally, musical instruments have been proposed that generate electronic sound in response to music playing movements, when music playing movements of a player are detected. For example, a musical instrument (air drum) has been known that generates a percussion instrument sound with only a stick-shaped component, and with this musical instrument, a sensor is provided to the stick-shaped component, the sensor detecting a music playing movement by a player holding the component by hand and waving, and then a percussion instrument sound is generated.

According to such a musical instrument, music notes of this instrument can be generated without requiring a real instrument; therefore, it enables the enjoyment of music playing without being subjected to limitations in the music playing location or music playing space.

In regards to such a musical instrument, an instrument game device is proposed in FIG. 1 of Japanese Patent No. 3599115, for example, that is configured so as to capture an image of a music playing movement of a player using a stick-shaped component, while displaying a composite image combining this music playing movement and a virtual image showing an instrument set on a monitor, and generates a predetermined musical note depending on position information of the stick-shaped component and the virtual instrument set.

However, with the musical instrument capturing an image of a player and generating musical notes, the music-playing component must be identifiable from the captured image. More specifically, the position coordinates of a portion of the music-playing component contacting the virtual instrument must be specified in the captured image.

In this respect, with the instrumental game device described in Japanese Patent No. 3599115, it is configured so that a lamp is provided to a leading end of a penlight used by the player (FIG. 4), and the portion contacting the virtual instrument is distinguished by specifying the position coordinates of this lamp.

As a result, an electrical source for switching on the lamp is required in the music-playing component (penlight). However, in order to realize the aforementioned characteristic of not being subjected to the limitations in the music playing location and music playing space, it is necessary to provide an electrical source inside of the music-playing component that does not supply electrical power by wires, such as a battery. In addition, in view of characteristics of holding and playing by the player, the music-playing component requires a certain curbing of the weight thereof, and thus a simple means of providing a large battery in order to enable use over a long time period is not preferable.

In this regard, with the instrumental game device of Japanese Patent No. 3599115, switch-on control of this lamp is in no way taken into account, and thus a further improvement has been demanded from the viewpoint of a reduction in the electricity consumption of the music-playing component.

SUMMARY OF THE INVENTION

The present invention has been made by taking such demands into account, and has an object of providing a musical instrument and light-emission controller that realize a reduction in the electricity consumption of a music-playing component, in a musical instrument that generates musical notes based on the position coordinates of a light-emitting part of the music-playing component in image-capture space.

In order to achieved the above-mentioned object, a musical instrument according to an aspect of the present invention includes: a music-playing component to be held by a player, and including a light-emitting part that emits light and switches off; an image-capturing device that captures an image of an image-capture space that contains the player holding the music-playing component; a sound generating device that generates sound based on a position of the light-emitting part while emitting light in the image-capture space captured by the image-capturing device; a detector that detects start and end of a down swing movement of the music-playing component by the player; and a light-emission controller that (a) controls the light-emitting part to emit light when the detector detects the start of the down swing movement, and (b) controls the light-emitting part to switch off when the detector detects the end of the down swing movement.

In addition, a light-emission controller according to an aspect of the present invention includes: a detector that detects start and end of a movement provided to a component having a light-emitting part; and a control unit that (a) switches on the light-emitting part in response to the start of the movement detected by the detector, and (b) switches off the light-emitting part in response to the end of the movement detected by the detector.

Furthermore, in a control method of a musical instrument according to an aspect of the present invention comprising a music-playing component to be held by a player and including (i) a light-emitting part that emits light and switches off, (ii) an image-capturing device and (iii) a sound generating device, the method includes the steps of: capturing an image of an image-capture space that contains the player holding the music-playing component by the image-capturing device; generating sound by the sound generating device based on a position of the light-emitting part while emitting light in the image-capture space captured by the image-capturing device; detecting start and end of a down swing movement of the music-playing component by the player; and controlling the light-emitting part (a) to emit light when the start of the down swing movement is detected in the detecting step, and (b) to switch off when the end of the down swing movement is detected in the detecting step.

DETAILED DESCRIPTION OF THE INVENTION

Hereinafter, embodiments of the present invention will be explained while referencing the drawings.

Overview of Musical Instrument 1

First, an overview of a musical instrument 1 as an embodiment of the present invention will be explained while referencing FIGS. 1A and 1B.

Figure 1A:
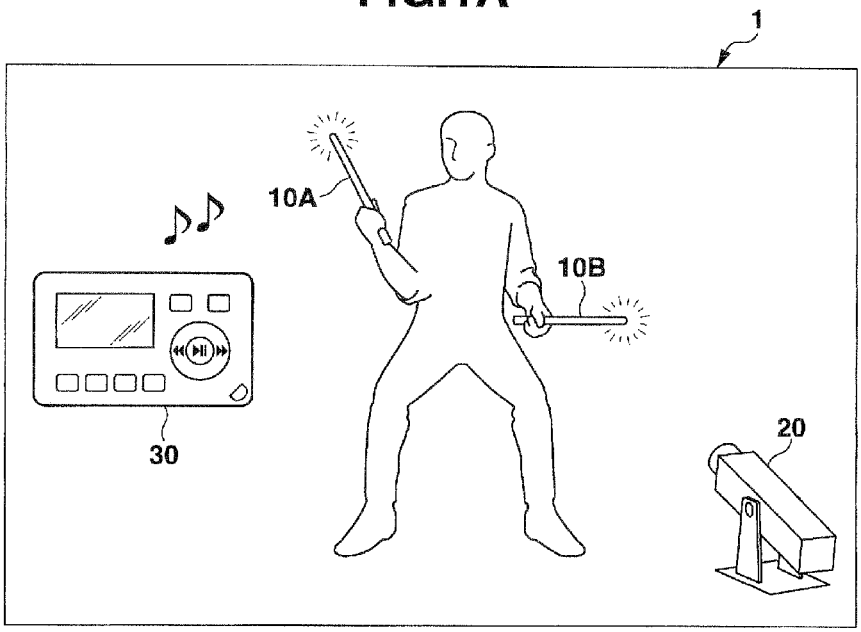
FIGS. 1A and 1B are illustrations showing an overview of an embodiment of a musical instrument according to the present invention.
Figure 1B:
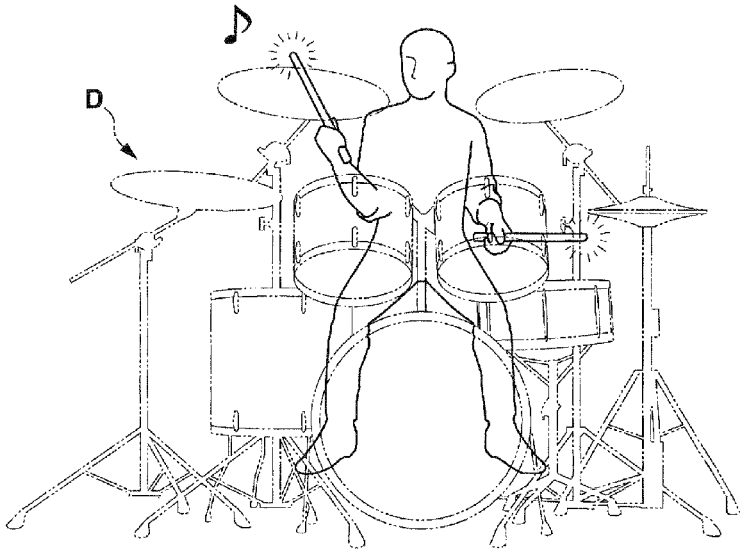

As shown in FIG. 1A, the musical instrument 1 of the present invention is configured to include sticks 10A, 10B, a camera unit 20, and a center unit 30. The musical instrument 1 of the present embodiment is configured to include the two sticks 10A, 10B in order to realize a virtual drum playing using two sticks. However, the number of sticks is not limited thereto, and may be one, or may be three or more. It should be noted that, in cases not distinguishing between sticks 10A and 10B, they both will be generalized and referred to as "sticks 10" hereinafter.

The sticks 10 are members of stick shape extending in a longitudinal direction, and correspond to a music-playing component of the present invention. A player conducts a music playing movement by making up swing and down swing movements about the wrist, etc. holding one end (base side) of the stick 10 in the hand. Various sensors such as an acceleration sensor are provided in the other end (leading end side) of the stick 10 in order to detect such a music playing movement of the player. Then, based on the music playing movement detected by the various sensors, the stick 10 sends a Note-on-Event to the center unit 30.

In addition, a marker 15 (refer to FIG. 2) described later is provided to the leading end side of the stick 10, and the camera unit 20 is configured to be able to distinguish the leading end of the stick 10 during image capturing.

The camera unit 20 is an optical camera that captures an image of the player carrying out music playing movements holding the sticks 10 at a predetermined frame rate, and corresponds to an image capturing device of the present invention. The camera unit 20 specifies position coordinates within image capturing space of the marker 15 while emitting light and transmits the position coordinates to the center unit 30.

Upon receiving a Note-on-Event from the stick 10, the center unit 30 generates a predetermined musical note in response to the position coordinate data of the marker 15 during reception. More specifically, the center unit 30 stores position coordinate data of a virtual drum set D shown in FIG. 1B, to be associated with the image capturing space of the camera unit 20. Then, based on the position coordinate data of this virtual drum set D and the position coordinate data of the marker 15 during Note-on-Event reception, an instrument struck by the stick 10 is specified, and a musical note corresponding to the instrument is generated.

In the musical instrument 1, such sticks 10 of the present embodiment perform light-emission control and switch-off control of the marker 15, while decreasing the electricity consumption. More specifically, although it is necessary to generate musical notes when the sticks 10 strike a virtual instrument in the musical instrument 1, generally, in a percussion instrument, the striking by the stick 10 is carried out when the stick 10 is swung down, and is not carried out when the stick 10 is swung up.

Therefore, the sticks 10 of the present embodiment realize a reduction in electricity consumption by performing light-emission control of the marker 15 on the condition of detecting start of a down swing movement, and subsequently, performing switch-off control of the marker 15 on the condition of detecting the end of the down swing movement and start of an up swing movement. It should be noted that the light-emission control refers to control causing the marker 15 to emit light and control to maintain a light-emitting state. However, the light-emitting state is not only a state always emitting light, and includes a state temporarily switching off as in blinking. In addition, switch-off control refers to control to switch off light emission of the marker 15 and control to maintain the switched off state.

Hereinafter, an embodiment of the present invention will be specifically explained.

Configuration of Musical Instrument 1

Figure 2:
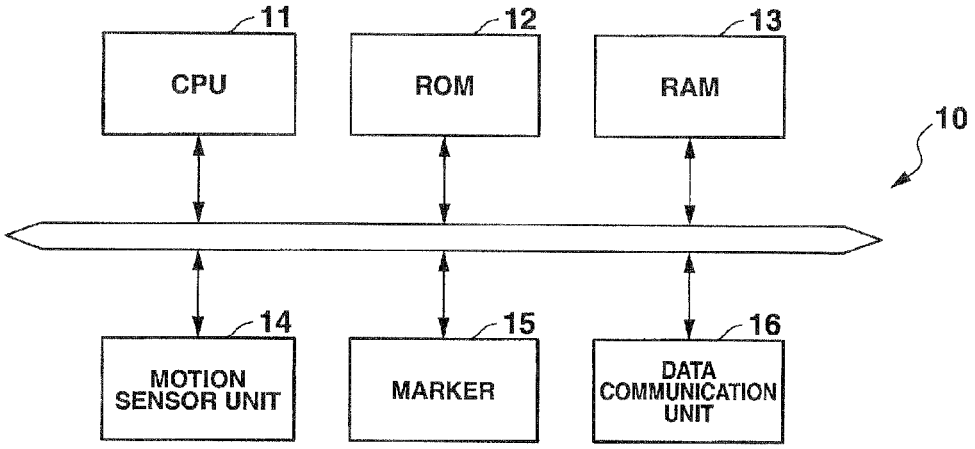
FIG. 2 is a block diagram showing the hardware configuration of a stick configuring the musical instrument.
Figure 3:
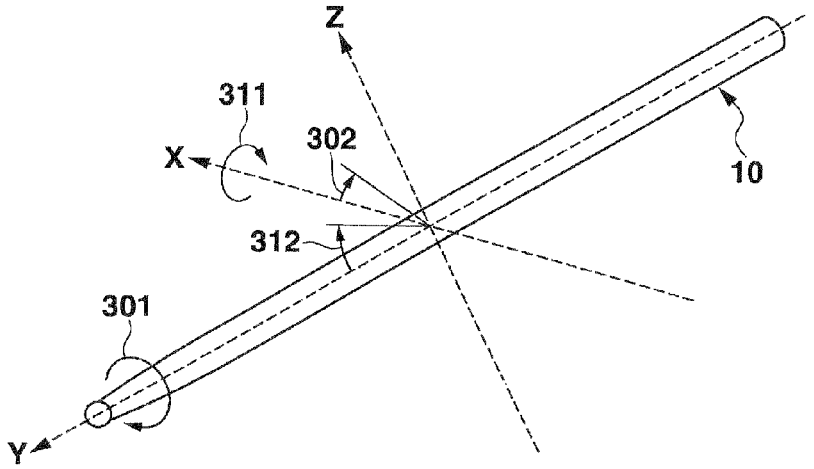
FIG. 3 is a perspective view of the stick.
Figure 4:
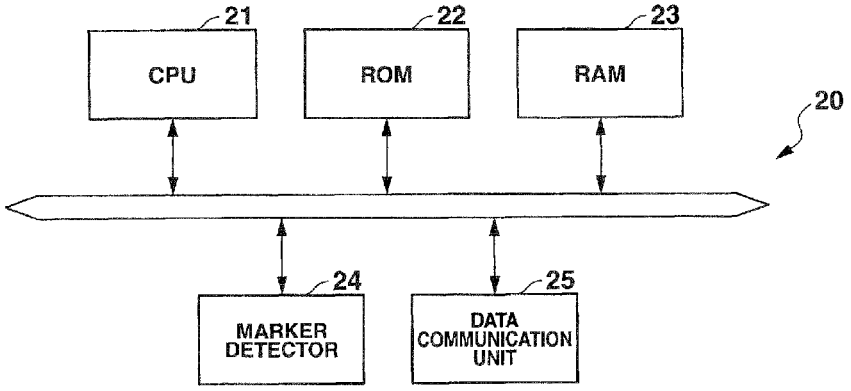
FIG. 4 is a block diagram showing the hardware configuration of a camera unit configuring the musical instrument.
Figure 5:
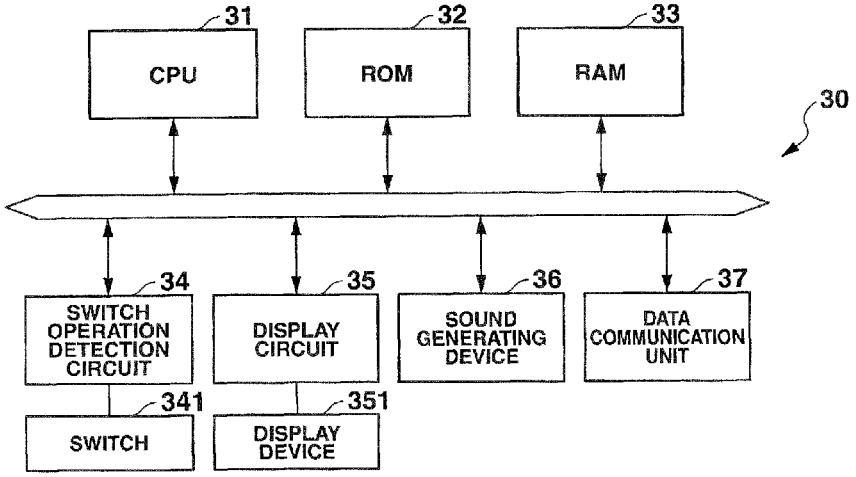
FIG. 5 is a block diagram showing the hardware configuration of a center unit configuring the musical instrument.

First, the configurations of the sticks 10, camera unit 20 and center unit 30 configuring the musical instrument 1 of the present invention will be explained while referencing FIGS. 2 to 5. FIG. 2 is a block diagram showing the hardware configuration of the stick 10. FIG. 3 is a perspective view showing the stick 10. FIG. 4 is a block diagram showing the hardware configuration of the camera unit 20. FIG. 5 is a block diagram showing the hardware configuration of the center unit 30.

Configuration of Sticks 10

As shown in FIG. 2, the stick 10 is configured to include a CPU 11 (Central Processing Unit), ROM 12 (Read Only Memory), RAM 13 (Random Access Memory), a motion sensor unit 14, the marker 15, and a data communication unit 16.

The CPU 11 executes control of the overall stick 10, and in addition to detection of the attitude of the stick 10, shot detection and movement detection based on the sensor values outputted from the motion sensor unit 14, for example, also performs control such as light-emission and switch-off of the marker 15. At this time, the CPU 11 reads marker characteristic information from the ROM 12, and performs light-emission control of the marker 15 in accordance with this marker characteristic information. In addition, the CPU 11 performs communication control with the center unit 30 via the data communication unit 16.

The ROM 12 stores processing programs for various processing executed by the CPU 11. In addition, the ROM 12 stores the marker characteristic information used in the light-emission control of the marker 15. Herein, the camera unit 20 must distinguish between the marker 15 of the stick 10A (first marker) and the marker 15 of the stick 10B (second marker). Marker characteristic information is information for the camera unit 20 to distinguish between the first marker and the second marker. For example, in addition to the shape, size, color, chroma, or brightness during light emission, it is possible to use the blinking speed or the like during light emission.

The CPU 11 of the stick 10A and the CPU 11 of the stick 10B read respectively different marker characteristic information, and perform light-emission control of the respective markers.

The RAM 13 stores the values acquired or generated in processing such as various sensor values outputted by the motion sensor unit 14.

The motion sensor unit 14 is various sensors for detecting the state of the stick 10, and outputs predetermined sensor values. Herein, an acceleration sensor, angular velocity sensor, magnetic sensor, or the like can be used as the sensors configuring the motion sensor unit 14, for example.

A three-axis sensor that outputs the acceleration occurring in each of the three axis directions of the X axis, Y axis and Z axis can be employed as the acceleration sensor. It should be noted that, as shown in FIG. 3, for the X axis, Y axis and Z axis, the axis matching the longitudinal axis of the stick 10 is defined as the Y axis, the axis that is parallel to the substrate (not illustrated) on which the acceleration sensor is arranged and perpendicular to the Y axis is defined as the X axis, and the axis that is perpendicular to both the X axis and Y axis can be defined as the Z axis. At this time, it may be configured so that the acceleration sensor acquires the acceleration of each component of the X axis, Y axis and Z axis, as well as calculating the sensor composite value combining the respective accelerations. Herein, the player holds one end (base side) of the stick 10, and carries out a swing up and swing down movement about the wrist or the like, thereby giving rise to a rotational motion on the stick 10. Then, in response thereto, in a case of the stick 10 standing still, the acceleration sensor calculates a value corresponding to gravitational acceleration 1G as the sensor composite value, and in a case of the stick 10 undergoing rotational motion, the acceleration sensor calculates a value larger than the gravitational acceleration 1G as the sensor composite value. It should be noted that the sensor composite value is obtained by calculating the square root of the sum total of the squares of each acceleration of the components of the X axis, Y axis and Z axis, for example.

In addition, a sensor equipped with a gyroscope can be employed as the angular velocity sensor, for example. Herein, as shown in FIG. 3, the angular velocity sensor outputs a rotation angle 301 of the stick 10 in the Y axis direction and a rotation angle 311 of the stick 10 in the X axis direction.

Herein, the rotation angle 301 in the Y axis direction is the rotation angle in a front-back axis viewed from the player when the player holds the stick 10; therefore, it can be referred to as roll angle. The roll angle corresponds to the angle 302 showing how much the X-Y plane has been tilted relative to the X axis, and is produced from the player holding the stick 10 in a hand, and causing to rotate left and right about the wrist.

In addition, the rotation angle 311 in the X axis direction is the rotation angle in a left-right axis viewed from the player when the player holds the stick 10; therefore, it is can be referred to as pitch angle. The pitch angle corresponds to the angle 312 showing how much the X-Y plane is tilted relative to the Y axis, and is produced by the player holding the stick 10 in a hand, and waving the wrist in a vertical direction.

It should be noted that, although an illustration is omitted, the angular velocity sensor may be configured to jointly output the rotational angle in the Z axis direction as well. At this time, the rotation angle in the Z axis direction basically has the same property as the rotation angle 311 in the X axis direction, and is a pitch angle produced by the player holding the stick 10 in a hand, and waving the wrist in the vertical direction.

In addition, a sensor capable of outputting a magnetic sensor value in the three axis directions of the X axis, Y axis and Z axis shown in FIG. 3 can be employed as the magnetic sensor. Based on such a magnetic sensor, a vector indicating north (magnetic north) according to a magnet is output for each of the X axis direction, Y axis direction and Z axis direction. The components of the respective axial directions outputted differ according to the attitude (orientation) of the stick 10; therefore, the CPU 11 can calculate from these components the roll angle and rotation angles in the X axis direction and Z axis direction of the stick 10.

The motion sensor unit 14 (in detail, the CPU 11 receiving sensor values from the motion sensor unit 14) uses such various sensors to detect the state of the stick 10 being held by the player (can also be called music playing state of player). As one example, the CPU 11 detects the striking timing of a virtual instrument by the stick 10 (shot timing) based on the acceleration output by the acceleration sensor (or sensor composite value). In addition, the CPU 11 detects a swing down movement and swing up movement of the stick 10 based on the sensor value outputted from each sensor.

Referring back to FIG. 2, the marker 15 is a luminous body such as an LED provided on a leading end side of the stick 10, for example, and emits light and switches off depending on the control of the CPU 11. More specifically, the marker 15 emits light based on the marker characteristic information read by the CPU 11 from the ROM 12. At this time, since the marker characteristic information of the stick 10A and the marker characteristic information of the stick 10B differ, the camera unit 20 can distinctly acquire the position coordinates of the marker of the stick 10A (first marker) and the position coordinates of the marker of the stick 10B (second marker).

The data communication unit 16 performs predetermined wireless communication with at least the center unit 30

The predetermined wireless communication may be configured to be performed by any method, and in the present embodiment, wireless communication with the center unit 30 is performed by way of infrared communication. It should be noted that the data communication unit 16 may be configured to perform wireless communication with the camera unit 20, and may be configured to perform wireless communication with the stick 10A and the stick 10B.

Configuration of Camera Unit 20

The explanation for the configuration of the stick 10 is as given above. Next, the configuration of the camera unit 20 will be explained while referencing FIG. 4.

The camera unit 20 is configured to include a CPU 21, ROM 22, RAM 23, a marker detector 24, and data communication unit 25.

The CPU 21 executes control of the overall camera unit 20. For example, based on position coordinate data of the marker 15 detected by the marker detector 24 and marker characteristic information, the CPU 21 performs control to calculate the position coordinate data of each of the markers 15 (first marker and second marker) of the sticks 10A and 10B. In addition, the CPU 21 performs communication control to transmit the calculated position coordinate data and the like to the center unit 30 via the data communication unit 25.

The ROM 22 stores processing programs of various processing executed by the CPU 21. The RAM 23 stores values acquired or generated in the processing such as position coordinate data of the marker 15 detected by the marker detector 24. In addition, the RAM 23 jointly stores the marker characteristic information of each of the sticks 10A and 10B received from the center unit 30.

The marker detector 24 is an optical camera, for example, and captures images of the player carrying out music playing movements while holding the sticks 10 at a predetermined frame rate. In addition, the marker detector 24 outputs image capture data of each frame to the CPU 21. It should be noted that, although the camera unit 20 is configured to specify the position coordinates of the marker 15 of the stick 10 within image capture space, specifying of the position coordinates of the marker 15 may be performed by the marker detector 24, or may be performed by the CPU 21. Similarly, the marker characteristic information of the captured marker 15 also may be specified by the marker detector 24, or may be specified by the CPU 21.

The data communication unit 25 performs predetermined wireless communication (e.g., infrared communication) with at least the center unit 30. It should be noted that the data communication unit 25 may be configured to perform wireless communication with the sticks 10.

Configuration of Center Unit 30

The explanation for the configuration of the camera unit 20 is as given above. Next, the configuration of the center unit 30 will be explained while referencing FIG. 5.

The center unit 30 is configured to include a CPU 31, ROM 32, RAM 33, a switch operation detection circuit 34, a display circuit 35, a sound generating device 36, and a data communication unit 37.

The CPU 31 executes control of the overall center unit 30. For example, based on the shot detection received from the stick 10 and the position coordinates of the marker 15 received from the camera unit 20, the CPU 31 performs control such as to generate predetermined musical notes. In addition, the CPU 31 performs communication control with the sticks 10 and the camera unit 20 via the data communication unit 37.

The ROM 32 stores processing programs of various processing executed by the CPU 31. In addition, to be associated with the position coordinates and the like, the ROM 32 stores the waveform data of wind instruments such as the flute, saxophone and trumpet, keyboard instruments such as the piano, stringed instruments such as the guitar, and percussion instruments such as the bass drum, high-hat, snare, cymbal and tam.

By the CPU 31 reading the waveform stored in the ROM 32 to be associated with the position coordinates of the marker 15 upon shot detection (i.e. upon Note-on-Event reception), a musical note in accordance with the music playing movement of the player is generated.

The RAM 33 stores values acquired or generated in processing such as the state of the stick 10 received from the stick 10 (shot detection, etc.) and the position coordinates of the marker 15 received from the camera unit 20.

The switch operation detection circuit 34 is connected with a switch 341, and receives input information through this switch 341. The input information includes a change in the volume of a musical note generated or tone of a musical note generated, a switch in the display of the display device 351, and the like, for example.

In addition, the display circuit 35 is connected with a display device 351, and performs display control of the display device 351.

In accordance with an instruction from the CPU 31, the sound generating device 36 reads waveform data from the ROM 32, generates musical note data and converts the musical note data into an analog signal, and then generates musical notes from a speaker, which is not illustrated.

In addition, the data communication unit 37 performs predetermined wireless communication (e.g., infrared communication) with the sticks 10 and the camera unit 20.

Processing of Musical Instrument 1

Figure 6:
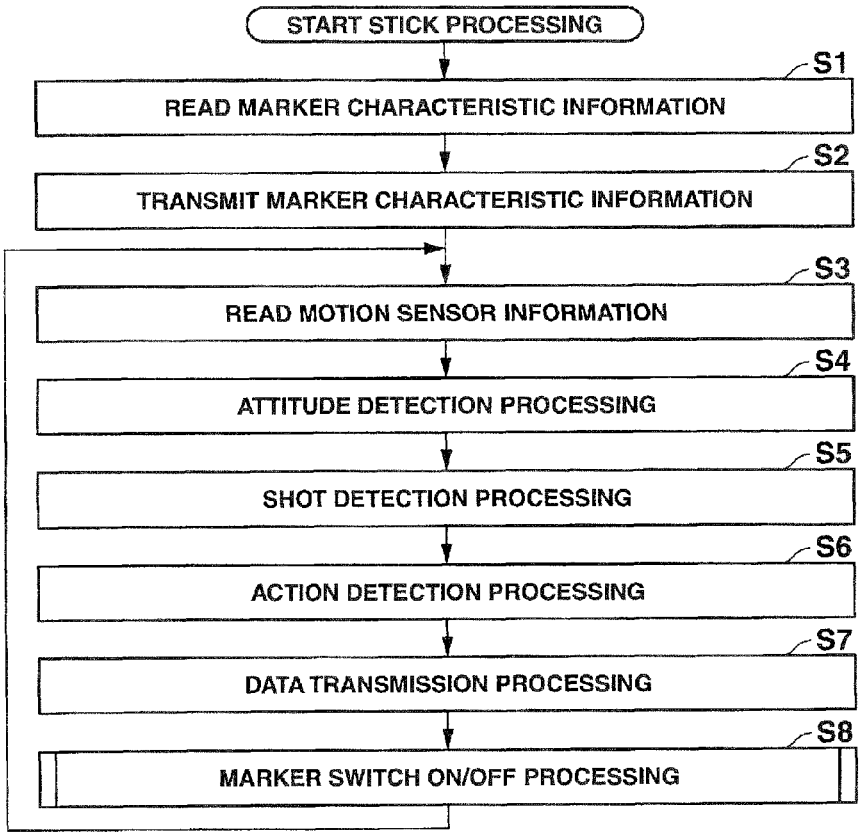
FIG. 6 is a flowchart showing the flow of processing of the stick.
Figure 7:
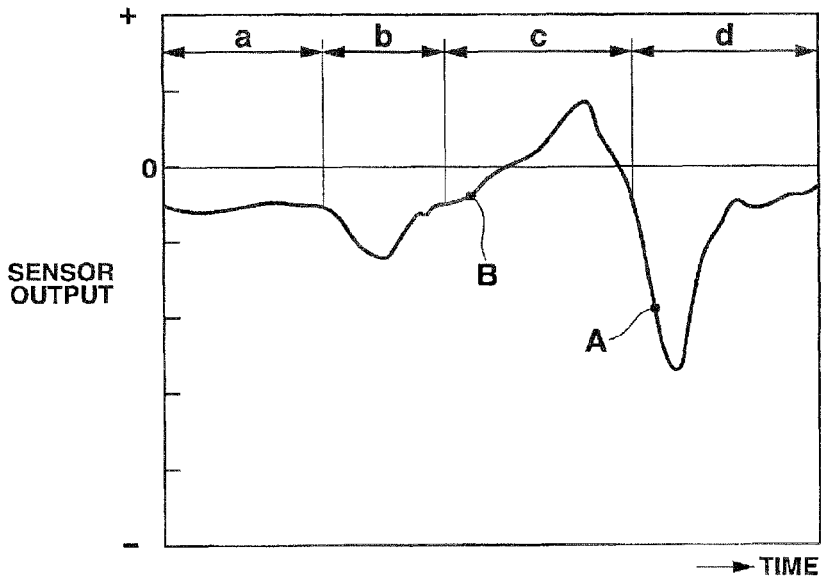
FIG. 7 is a graph expressing the change in output of a motion sensor relative to acceleration in the vertical direction.
Figure 8:
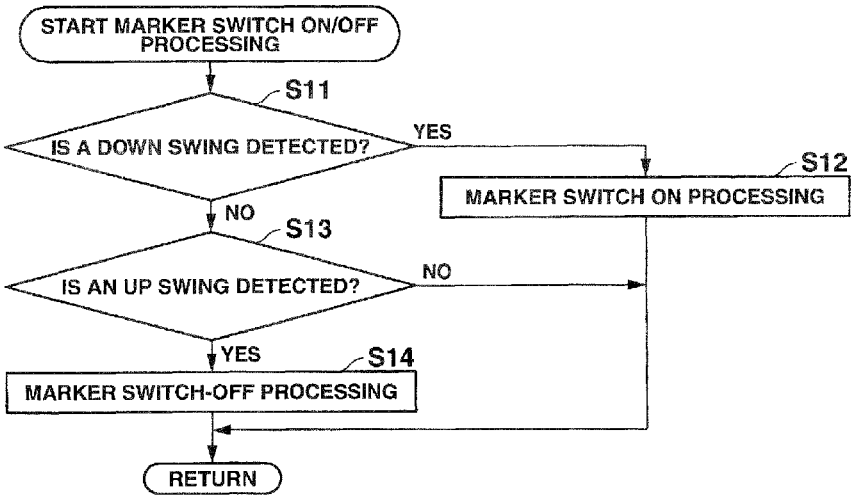
FIG. 8 is a flowchart showing the flow of processing of the stick.
Figure 9:
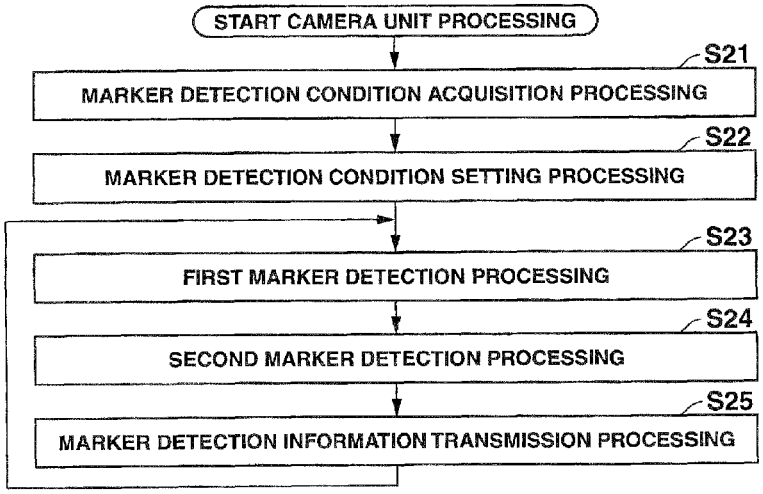
FIG. 9 is a flowchart showing the flow of processing of the camera unit.
Figure 10:
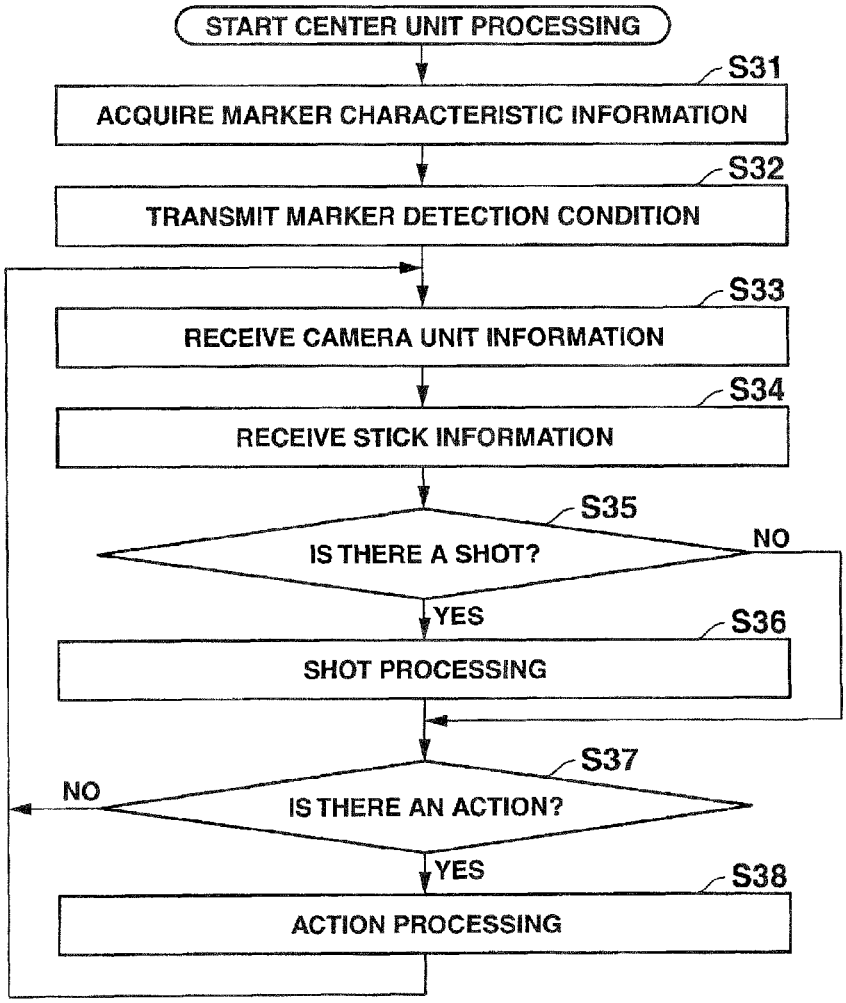
FIG. 10 is a flowchart showing the flow of processing of the center unit.

The configurations of the sticks 10, camera unit 20 and center unit 30 configuring the musical instrument 1 have been explained in the foregoing. Next, processing of the musical instrument 1 will be explained while referencing FIGS. 6 to 10. FIG. 6 is a flowchart showing processing of the sticks 10. FIG. 7 is a graph showing the shot detection timing of the sticks 10 (Note-on-Event generation timing). FIG. 8 is a flowchart showing marker switch-off processing of the sticks 10. In addition, FIG. 9 is a flowchart showing processing of the camera unit 20. FIG. 10 is a flowchart showing processing of the center unit 30.

Processing of Sticks 10

As shown in FIG. 6, the CPU 11 of the stick 10 reads marker characteristic information stored in the ROM 12 (Step S1). In this processing, the CPUs 11 of the sticks 10A, 10B each read different marker characteristic information. The reading of different marker characteristic information can be performed by any method. For example, it may be configured to be performed by the sticks 10A, 10B communicating directly or via the center unit 30. Alternatively, it may be configured so as to associate one set of marker characteristic information to each of the individual sticks 10 in advance, and the CPUs 11 of the sticks 10A, 10B read the individual marker characteristic information respectively associated.

Upon reading the marker characteristic information, the CPU 11 stores this marker characteristic information in the RAM 13, and transmits to the center unit 30 via the data communication unit 16 (Step S2). At this time, the CPU 11 transmits the marker characteristic information to the center unit 30 to be associated with identifying information (stick identifying information) that can distinguish each of the sticks 10A and 10B.

Next, the CPU 11 reads motion sensor information from the motion sensor unit 14, i.e. sensor values outputted by various sensors, and stores the information in the RAM 13 (Step S3). Subsequently, the CPU 11 performs attitude detecting processing of the stick 10 based on the motion sensor information thus read (Step S4). In the attitude sensing processing, the CPU 11 detects the attitude of the stick 10, e.g., displacements or the like in the tilt, roll angle and pitch angle of the stick 10, based on the motion sensor information.

Next, the CPU 11 performs shot detection processing based on the motion sensor information (Step S5). Herein, in a case of a player carrying out music playing using the sticks 10, generally, similar movements as the movements to strike an actual instrument (e.g., drums) are performed. With such (music playing) movements, the player first swings up the stick 10, and then swings down towards a virtual instrument. Then, just before knocking the stick 10 against the virtual instrument, the player applies a force trying to stop the movement of the stick 10. At this time, the player assumes that a musical note will generate at the moment knocking the stick 10 against the virtual instrument; therefore, it is desirable to be able to generate a musical note at the timing assumed by the player. Therefore, in the present embodiment, it is configured so as to generate a musical note at the moment the player knocks the stick against the surface of a virtual instrument, or a short time before then.

Herein, an example of the generation timing of a musical note using the stick 10 will be explained while referencing FIG. 7. FIG. 7 is a graph expressing the change in output of the motion sensor unit 14 relative to the acceleration in the vertical direction in a case of performing a music playing movement using the sticks 10. It should be noted that acceleration in the vertical direction indicates acceleration in a vertical direction relative to a horizontal plane. This may be calculated by using the acceleration of the Y axis component. Alternatively, it may be calculated by resolving vectors of the acceleration in the Z axis direction (and acceleration in X axis direction according to roll angle) into the vertical direction. In addition, in FIG. 7, positive acceleration indicates acceleration in the downward direction applied to the stick 10, and negative acceleration indicates acceleration in the upward direction applied to the stick 10.

Even in a state in which the stick 10 is standing still (portion represented by "a" in FIG. 7), gravitational acceleration is being applied to the stick 10. As a result, the motion sensor unit 14 of the stick 10 standing still detects a constant acceleration vertically upwards, (i.e. negative acceleration direction in FIG. 7), countering the direction of the gravitational acceleration. It should be noted that the acceleration acting on the stick 10 becomes 0 when the stick is freely falling.

In the standing still state, when the player raises the stick 10 accompanying a swing up movement, it further moves in an opposite direction to gravitational acceleration. As a result, the acceleration applied to the stick 10 increases in the negative direction. Subsequently, when the raising speed is made to decrease in an effort to make stand still, the upward acceleration decreases, and the acceleration in the negative direction of the stick detected by the motion sensor unit 14 decreases (portion represented by "b" in FIG. 7). Then, the acceleration at the moment when the up swing movement arrives at a highest point is only gravitational acceleration (portion represented in the vicinity of the border between "b" and "c" in FIG. 7).

When the stick 10 reaches the top by the up swing movement, the player performs a down swing movement with the stick 10. With the down swing movement, the stick 10 comes to move downwards. Therefore, the acceleration applied to the stick 10 increases in the positive direction to more than the acceleration in the negative direction detected against the gravitational acceleration. Subsequently, since the player decreases the acceleration in the downward direction for the purpose of a shot, the acceleration applied to the stick 10 increases in the negative direction. In this period, after the timing at which the down swing movement reaches the highest speed, a state is re-entered in which only the gravitational acceleration acts on the stick 10 (portion represented by "c" in FIG. 7).

Thereafter, when the player further applies the acceleration in the up swing direction to the stick 10 with the purpose of a shot, the applied acceleration increases in the negative direction. Then, when the shot ends, the stick 10 comes to stand still again, and returns to a state in which the acceleration in the negative direction, countering the direction of the gravitational acceleration, is detected (portion represented by "d" in FIG. 7).

In the present embodiment, after the down swing movement has been performed, the moment at which the acceleration in the up swing direction is applied is detected as the moment when the player knocks the stick 10 against a surface of a virtual instrument. In other words, in the portion presented by "d" in FIG. 7, the point A at which the applied acceleration is further increased by a predetermined value in the negative direction from a down swing state, i.e. from the applied acceleration only being gravitational acceleration, is defined as the timing of shot detection.

With this timing of shot detection as a sound generation timing, when the aforementioned such sound generation timing is determined as having arrived, the CPU 11 of the stick 10 generates a Note-on-Event, and transmits to the center unit 30. Sound generation processing is thereby executed in the center unit 30, and a musical note generates.

Returning back to FIG. 6, in the shot detection processing shown in Step S5, Note-on-Event is generated based on motion sensor information (e.g., a sensor composite value of an acceleration sensor). At this time, it may be configured so as to include the volume of the generating musical note in the generated Note-on-Event. It should be noted that the volume of a musical note can be obtained from the maximum value of a sensor composite value, for example.

Next, the CPU 11 performs processing to detect information (hereinafter referred to as action information) indicating a predetermined movement (action) of the player based on the motion sensor information, i.e. action detection processing (Step S6). Next, the CPU 11 transmits information detected in the processing of Steps S4 to S6, i.e. attitude information, shot information and action information, to the center unit 30 via the data communication unit 16 (Step S7). At this time, the CPU 11 transmits the attitude information, shot information and action information to the center unit 30 to be associated with stick identifying information.

Next, the CPU 11 performs marker switch on/off processing (Step S8), advances to the processing of Step S3, and repeatedly executes this and following processing. Herein, although marker point switch on/off processing will be explained in detail with FIG. 8, the CPU 11 controls switching on and switching off of the marker 15 based on motion sensor information, etc.

Marker Switch on/Off Processing

Next, marker switch on/off processing will be explained while referencing FIG. 8.

First, the CPU 11 of the stick 10 determines whether or not a down swing has been detected based on the motion sensor information and attitude information, shot information, action information, etc. (Step S11). At this time, in a case of having detected a down swing, the CPU 11 performs switch-on processing of the marker 15 (Step S12), and marker switch on/off processing ends.

On the other hand, in a case of not having detected a down swing, the CPU 11 determines whether or not an up swing has been detected based on the motion sensor information, attitude information, shot information, action information, etc. (Step S13). At this time, in a case of an up swing having been detected, the CPU 11 performs switch-off processing of the marker 15 (Step S14), and the marker switch on/off processing ends. On the other hand, in a case of not having detected an up swing, the CPU 11 ends the marker switch on/off processing.

Herein, the detection of a down swing and up swing of Step S11 and Step S13 can be performed by any method, e.g., the acceleration of the stick 10 in a vertical direction of the stick 10 can be used. The detection of a down swing and an up swing by the CPU 11 will be explained hereinafter, taking a case of the change in acceleration of the motion sensor unit 14 in the vertical direction expressing a change such as that shown in FIG. 7 as an example.

Start of an up swing movement defines the timing of shot detection. More specifically, in the portion represented by "d" in FIG. 7, it is defined as the A point at which the applied acceleration has further increased by a predetermined value in the negative direction from a state of only gravitational acceleration. Naturally, it is possible to not set the start of up swing movement and the timing of shot detection to be the same, and provide a time lag between the two timings.

In addition, the start of a down swing movement is defined in the portion represented by "c" in FIG. 7 as point B at which the applied acceleration has increased by a predetermined value in the positive direction from the state of only gravitational acceleration. Herein, in a music playing operation such as of a normal percussion instrument, it is normal to perform an up swing movement immediately after a down swing movement. As a result, in the present embodiment, the end of a down swing movement and the start of an up swing movement are defined as the same timing. More specifically, a down swing movement initiates at the timing of point B in FIG. 7, and ends at the timing of point A. Naturally, a time lag can also be provided between the end of the down swing movement and the start of the up swing movement.

It should be noted that, in the present embodiment, it is configured so as to detect down swing and up swing movements based on the acceleration in the vertical direction detected by the motion sensor unit 14 (acceleration sensor). However, as another example, it may be configured so as to use the attitude information of the stick 10 in the detection of down swing and up swing movements. Herein, displacement in the pitch angle can be used as attitude information. For example, the CPU 11 detects down swing start in a case of the pitch angle having displaced downwards. In addition, the CPU 11 detects up swing start in a case of the pitch angle having displaced upwards or in a case of displacement of the pitch angle downwards having ended.

Furthermore, it may be configured so that the detection of down swing and up swing movements is performed by the camera unit 20. More specifically, it may be configured so that the camera unit 20 distinguishes the activity of the hand of the player from a captured image, and detects down swing and up swing movements. In this case, it may be configured so that the stick 10 receives this detection information from the camera unit 20.

Detection of down swing and up swing movements in Step S11 and Step S13 can be performed according to various methods.

It should be noted that, since the sticks 10 and camera unit 20 are asynchronous, the camera unit 20 may not perform suitable image capturing according to the timing at which the marker 15 switches off. Therefore, with the sticks 10, it may be configured so that the switch-off timing of the marker 15 is delayed by one captured frame of the camera unit 20. It is thereby possible with the camera unit 20 to specify the position coordinates of the marker 15 during shot timing, irrespective of the timing shift, which occurs asynchronously between the stick 10 and camera unit 20.

Processing of Camera Unit 20

As shown in FIG. 9, the CPU 21 of the camera unit 20 performs marker detection condition acquisition processing (Step S21). In this processing, the CPU 21 acquires marker detection condition information transmitted from the center unit 30, and stores the information in the RAM 23. It should be noted that marker detection condition information is a condition for detecting each of the markers 15 of the sticks 10A, 10B, and is generated from the marker characteristic information (refer to Step S31 and Step S32 in FIG. 10). Herein, the shape, size, color, chroma, or brightness of the marker can be used as the marker characteristic information as described above, for example. Next, the CPU 21 performs marker detection condition setting processing (Step S22). In this processing, the CPU 21 performs a variety of settings of the marker detector 24, based on the marker detection condition information.

Next, the CPU 21 performs first marker detection processing (Step S23) and second marker detection processing (Step S24). In the respective processing, the CPU 21 acquires, and stores in the RAM 23, marker detection information such as of the position coordinates, size and angle of the marker 15 (first marker) of the stick 10A and the marker 15 (second marker) of the stick 10B, detected by the marker detector 24. At this time, the marker detector 24 detects marker detection information for the markers 15 while emitting light.

Next, the CPU 21 transmits the marker detection information acquired in Step S23 and Step S24 to the center unit 30 via the data communication unit 24 (Step S25), and then advances to the processing of Step S23.

Processing of Center Unit 30

As shown in FIG. 10, the CPU 31 of the center unit 30 receives marker characteristic information from the sticks 10, and stores the information in the RAM 33 (Step S31). Next, the CPU 31 generates marker detection condition information from the detection conditions set through the marker characteristic information and switch 341, and then transmits the information to the camera unit 20 via the data communication unit 37 (Step S32).

Next, the CPU 31 receives marker detection information of each of the first marker and second marker from the camera unit 20, and stores the information in the RAM 33 (Step S33). In addition, the CPU 31 receives attitude information, shot information and action information associated with the stick identifying information from each of the sticks 10A, 10B, and stores in the RAM 33 (Step S34).

Next, the CPU 31 determines whether or not there is a shot (Step S35). In this processing, the CPU 31 determines the presence of a shot according to whether or not a Note-on-Event is received from the sticks 10. At this time, in a case of having determined that there is a shot, the CPU 31 performs shot processing (Step S36). In shot processing, the CPU 31 reads waveform data corresponding to the position coordinates, size, angle, etc. included in the marker detection information from the ROM 32, and outputs the data to the sound generating device 36 along with volume data included in the Note-on-Event. Then, the sound generating device 36 generates a corresponding musical note based on the accepted waveform data.

After Step S36, or in a case of determining NO in Step S35, the CPU 31 determines whether or not there is an action based on the action information received from the sticks 10 (Step S37). At this time, in a case of having determined that there is an action, the CPU 31 performs action processing based on the received action information (Step S38), and advances to the processing of Step S33. On the other hand, in a case of having determined there is no action, the CPU 31 advances to the processing of Step S33.

The configuration and processing of the musical instrument 1 of the present embodiment has been explained in the foregoing. According to such a musical instrument 1, the occurrence of an event (shot) for which position coordinate data of the marker 15 is necessary is estimated, the marker 15 is switched on in advance, and switching on of the marker 15 is ended at the time of this event ending. Since the marker 15 is made to switch on only for the period of time required for position coordinate data of the marker 15, the electricity consumption of the stick 10 can be reduced compared to a case of always being switched on, and it is possible to realize prolonged powering of the stick 10 and a weight reduction.

In addition, a visual rendered effect can be expected by the switch on/off movement of the marker 15 in connection with event (shot) occurrence, whereby it is possible to achieve an improvement in the performance of music using the stick 10.

Although an embodiment of the present invention has been explained in the foregoing, the embodiment is merely an exemplification, and is not to limit the technical scope of the present invention. The present invention can adopt various other embodiments, and further, various modifications such as omissions and substitutions can be made thereto within a scope that does not deviate from the gist of the present invention. These embodiments and modifications thereof are included in the scope and gist of the invention described in the present disclosure, and are included in the invention described in the accompanying claims and the scope of equivalents thereof.

In the above embodiment, a virtual drum set D (refer to FIG. 1B) has been explained as a virtual percussion instrument to give an example. However, it is not limited thereto, and the present invention can be applied to other instruments such as a xylophone, which generates musical notes by down swing movements of the sticks 10.

In addition, any processing among the processing configured to be performed by the sticks 10, camera unit 20 and center unit 30 in the above-mentioned embodiment may be configured to be performed by other units (sticks 10, camera unit 20 and center unit 30). For example, it may be configured so that processing such as shot detection, which has been configured to be performed by the CPU 11 of the stick 10, is performed by the center unit 30.

In addition, in the above-mentioned embodiment, light-emission control of the marker 15 possessed by the stick 10 has been explained. However, it is not limited to the sticks 10, and it may be configured so as to perform light-emission control of the present invention on another component having a light-emitting part. In other words, the present invention can be applied to a light-emission controller that detects the start or end of a movement provided to a component having a light-emitting part, and that switches on the light-emitting part in response to detection of the start of movement, as well as causing the light-emitting part to switch off in response to detection of the end of movement. At this time, sensing of the initiation and end of movement can be performed by a CPU (detector) based on a value detected by various sensors (motion sensor unit). In addition, light-emission control responsive to the initiation and end of movement can be performed by a CPU (controller) as well.

In the above-mentioned embodiment, light-emission switch-off control of the marker in response to detecting a start (initiation) and an end of a down swing movement are explained. However, it may be also adoptable that the controller of the light-emitting part controls luminance (brightness) of the marker. For example, it may be adoptable that (a) the controller controls the marker to emit relatively high-intensity light when the start of the down swing movement is detected, and (b) the controller controls the marker to emit relatively low-intensity light when the end of the down swing movement is detected. By adopting the above way of control, it is possible to achieve similar effect with the above-mentioned embodiment as well.

What is claimed is:

1. A musical instrument, comprising:

a music-playing component to be held by a player, and including a light-emitting part that emits light and switches off;

an image-capturing device that captures an image of an image-capture space that contains the player holding the music-playing component;

a sound generating device that generates sound based on a position of the light-emitting part while emitting light in the image-capture space captured by the image-capturing device;

a detector that detects a start and an end of a down swing movement of the music-playing component by the player; and a light-emission controller that (a) controls the light-emitting part to emit light when the detector detects the start of the down swing movement, and (b) controls the light-emitting part to switch off when the detector detects the end of the down swing movement.

2. The musical instrument according to claim 1, wherein the music-playing component includes an acceleration sensor that detects acceleration of the music-playing component in a vertical direction, and the detector detects the start and the end of the down swing movement based on the acceleration detected by the acceleration sensor.

3. The musical instrument according to claim 2, wherein the detector (a) detects the start of the down swing movement based on acceleration in a gravity direction detected by the acceleration sensor, and (b) detects the end of the down swing movement based on acceleration in a direction opposite to the gravity direction detected by the acceleration sensor.

4. The musical instrument according to claim 1, wherein the music-playing component, the image-capturing device, and the sound generating device are connected wirelessly.

5. The musical instrument according to claim 2, wherein the music-playing component, the image-capturing device, and the sound generating device are connected wirelessly.

6. The musical instrument according to claim 3, wherein the music-playing component, the image-capturing device, and the sound generating device are connected wirelessly.

7. A control method of a musical instrument, the musical instrument comprising (i) a music-playing component to be held by a player and including a light-emitting part that emits light and switches off, (ii) an image-capturing device, and (iii) a sound generating device, the method comprising:

capturing an image of an image-capture space that contains the player holding the music-playing component by the image-capturing device;

generating sound by the sound generating device based on a position of the light-emitting part while emitting light in the image-capture space captured by the image-capturing device;

detecting a start and an end of a down swing movement of the music-playing component by the player; and controlling the light-emitting part (a) to emit light when the start of the down swing movement is detected in the detecting step, and (b) to switch off when the end of the down swing movement is detected in the detecting step.

8. The control method of a musical instrument according to claim 7, wherein the music-playing component includes an acceleration sensor that detects acceleration of the music-playing component in a vertical direction, and the start and the end of the down swing movement is detected based on the acceleration detected by the acceleration sensor.

9. The control method of a musical instrument according to claim 8, wherein in the detecting, (a) the start of the down swing movement is detected based on acceleration in a gravity direction detected by the acceleration sensor, and (b) the end of the down swing movement is detected based on acceleration in a direction opposite to the gravity direction detected by the acceleration sensor.

10. The control method of a musical instrument according to claim 7, wherein the music-playing component, the image-capturing device, and the sound generating device are connected wirelessly.

11. The control method of a musical instrument according to claim 8, wherein the music-playing component, the image-capturing device, and the sound generating device are connected wirelessly.

12. The control method of a musical instrument according to claim 9, wherein the music-playing component, the image-capturing device, and the sound generating device are connected wirelessly.

* * * * *